US007713073B2

(12) United States Patent
Lin

(10) Patent No.: US 7,713,073 B2
(45) Date of Patent: May 11, 2010

(54) POWER ADAPTER

(75) Inventor: Chen-Che Lin, Keelung (TW)

(73) Assignee: Transpower Technology Co., Ltd., Taipei County (TW)

( * ) Notice: Subject to any disclaimer, the term of this patent is extended or adjusted under 35 U.S.C. 154(b) by 0 days.

(21) Appl. No.: 12/010,455

(22) Filed: Jan. 25, 2008

(65) Prior Publication Data

US 2009/0191735 A1 Jul. 30, 2009

(51) Int. Cl.
*H01R 13/44* (2006.01)

(52) U.S. Cl. ..... 439/131; 439/501; 439/638

(58) Field of Classification Search ..... 439/131, 439/501, 638, 528
See application file for complete search history.

(56) References Cited

U.S. PATENT DOCUMENTS 4,647,139 A * 3/1987 Yang ..... 439/483
5,906,509 A * 5/1999 Wu ..... 439/518
6,416,355 B1 * 7/2002 Liao ..... 439/501
6,612,875 B1 * 9/2003 Liao ..... 439/675
6,790,062 B1 * 9/2004 Liao ..... 439/171
7,300,306 B2 * 11/2007 Le et al. ..... 439/502
7,329,152 B2 * 2/2008 Mori et al. ..... 439/638
7,354,315 B2 * 4/2008 Goetz et al. ..... 439/669
7,357,666 B2 * 4/2008 Wu ..... 439/501
7,393,242 B1 * 7/2008 Saje ..... 439/501
2008/0050975 A1 * 2/2008 Liao ..... 439/660

* cited by examiner

*Primary Examiner*—Tho D Ta
*Assistant Examiner*—Travis Chambers
(74) *Attorney, Agent, or Firm*—Rosenberg, Klein & Lee

(57) ABSTRACT

A power adapter includes a housing, a power input portion and a connecting wire. The housing has a reel device mounted therein, and a wire outlet and more than one output portions formed in one side wall. The power input portion is mounted on the housing. A first end of the connecting wire is extended into the housing through the wire outlet and connected with the reel device thereby the connecting wire can be retracted via the reel device, and a second end thereof is connected with an electrical connector which extends out of the wire outlet. Basing on the structure, the connecting wire can be pulled out of the power adapter for use or retracted in the power adapter for collection via the reel device.

12 Claims, 9 Drawing Sheets

POWER ADAPTER

BACKGROUND OF THE INVENTION

1. Field of the Invention

The present invention relates to a power adapter, especially to a power adapter with a connecting wire which can be pulled out of the power adapter and retracted in the power adapter.

2. Description of Related Art

Portable electronic products (for example, portable drives and mobile phones) generally use batteries to supply power needed for work. Once the batteries have run down, the electronic products need to be connected with power adapters for energy supplement.

A conventional power adapter generally has a housing which forms a power input portion for connecting to the mains supply, a vehicle power supply, etc. and a USB port in one side wall. The electronic product described above usually is provided with a transmission line. One end of the transmission line is mounted a USB plug on for engaging with the USB port of the housing, the other end is connected with the electronic product, whereby power may be transmitted to the electronic device through the power adapter and the transmission line.

However, conventional power adapters must be used with transmission lines for electronic devices. When forgetting to carry the transmission lines, users cannot use the power adapters. So users must carry the transmission lines besides the power adapters, which adds to the users' burden. Further, the transmission lines are difficult to collect and carry.

Hence, the inventors of the present invention believe that the shortcomings described above are able to be improved and finally suggest the present invention which is of a reasonable design and is an effective improvement based on deep research and thought.

SUMMARY OF THE INVENTION

A main object of the present invention is to provide a power adapter which has a retractable connecting wire, wherein the connecting wire may be pulled out of the power adapter for use or retracted in the power adapter for collection via a reel device mounted in the power adapter.

Another object of the present invention is to provide a power adapter which can be connected to different electronic devices via a retractable connecting wire and a preset output portion for supplying power for more than one electronic devices simultaneously.

To achieve the above-mentioned objects, a power adapter in accordance with the present invention is provided. The power adapter includes a housing, a power input portion and a connecting wire. The housing has a reel device mounted therein, and a wire outlet and more than one output portions formed in one side wall. The power input portion is mounted on the housing. A first end of the connecting wire is extended into the housing through the wire outlet and connected with the reel device thereby the connecting wire can be retracted via the reel device, and a second end thereof is connected with an electrical connector which extends out of the wire outlet.

The efficacy of the present invention is as follows: as long as users pull the connecting wire out of the power adapter to connect it with an electronic device needed to be charged, the power adapter of the present invention can be connected to the electronic device and transmit energy to the electronic device without a transmission line; further, when the power adapter is in an unused state, the connecting wire can be automatically retracted in the power adapter; so users needn't carry the transmission line for the electronic device in addition and the power adapter is more convenient for operating and carrying.

To further understand features and technical contents of the present invention, please refer to the following detailed description and drawings related the present invention. However, the drawings are only to be used as references and explanations, not to limit the present invention.

DETAILED DESCRIPTION OF THE PREFERRED EMBODIMENTS

Figure 1:
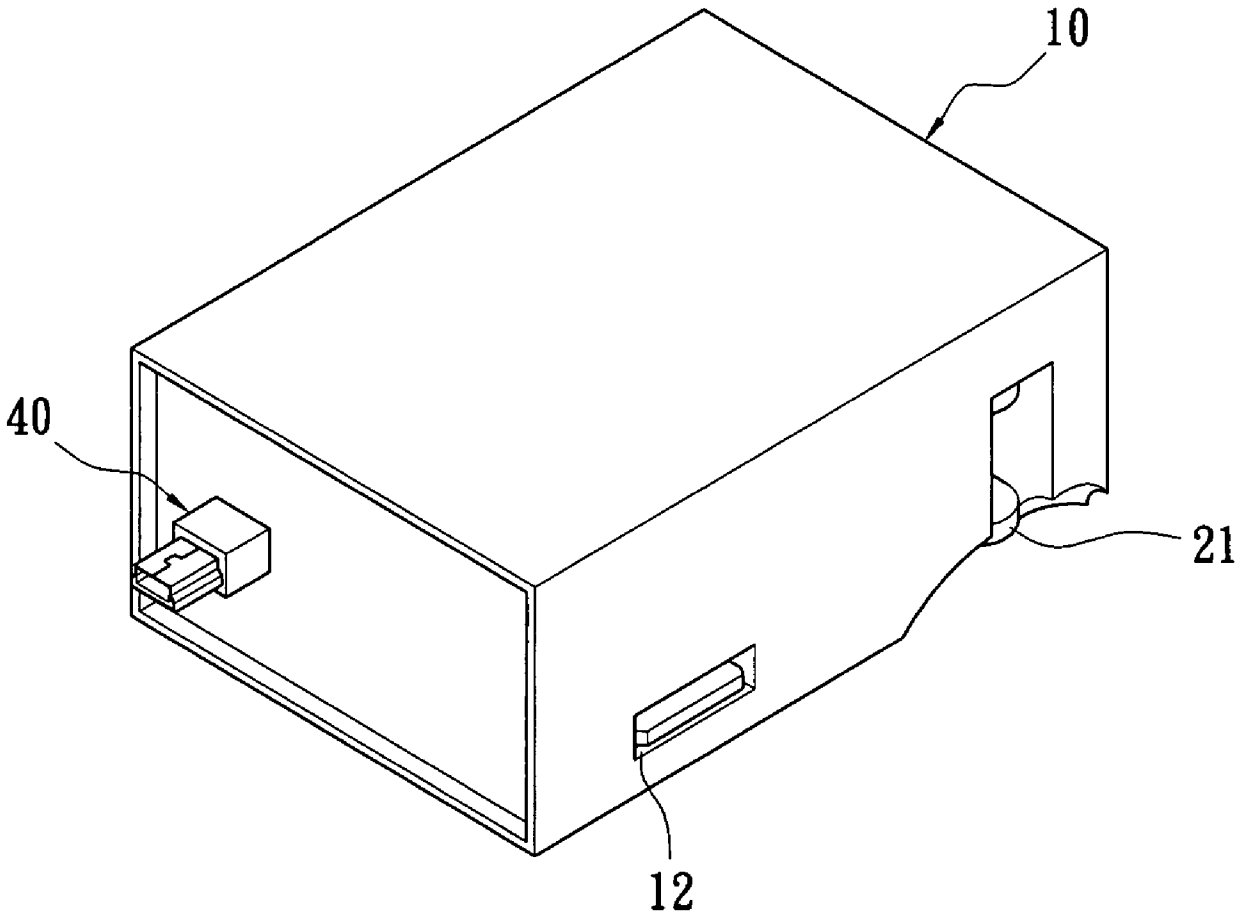
FIG. 1 is a perspective view of a first embodiment of the present invention.
Figure 2:
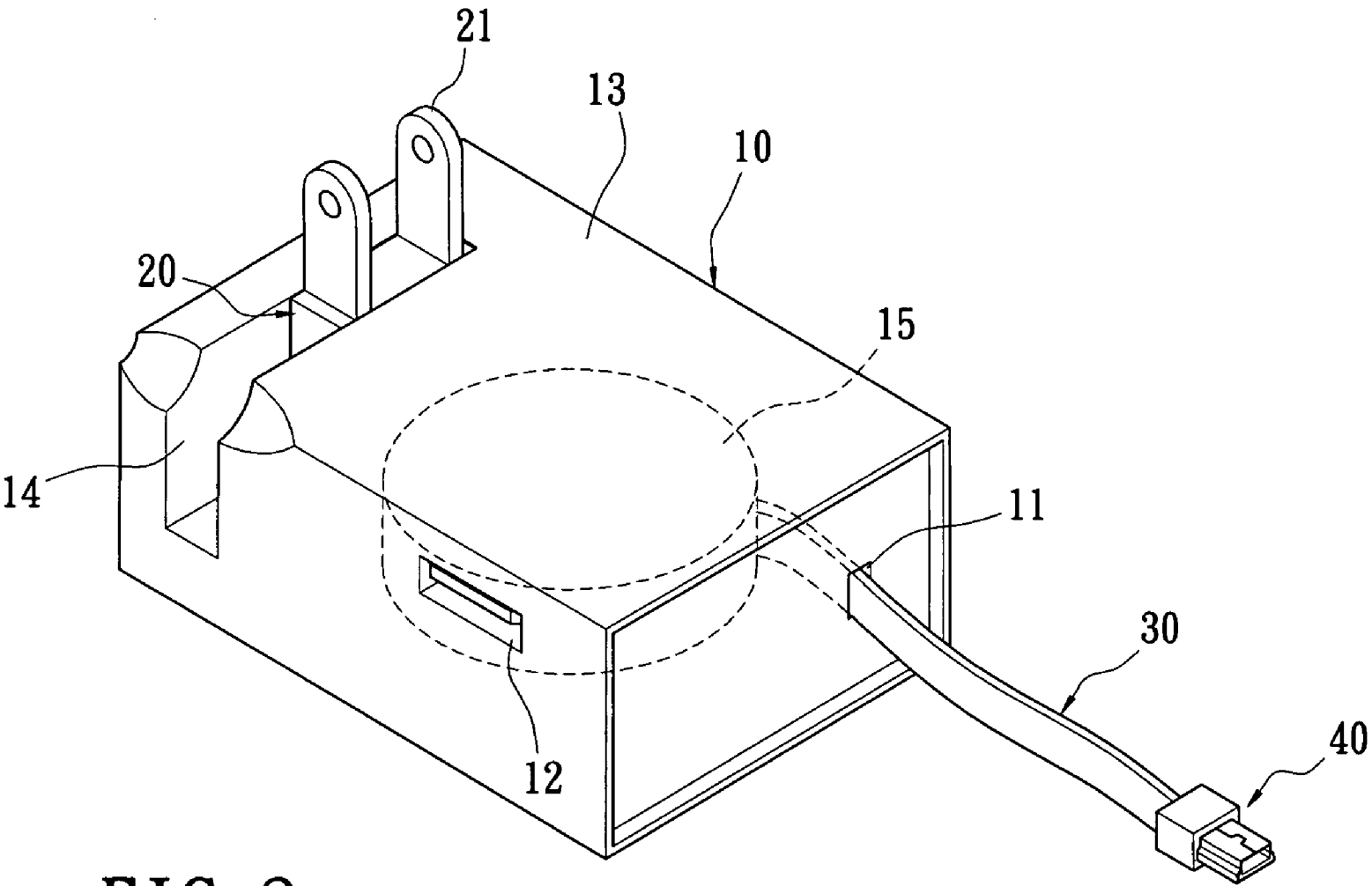
FIG. 2 is a perspective view of the first embodiment of the present invention, from another angle.

Please refer to FIG. 1 and FIG. 2 illustrating a first embodiment of a power adapter according to the present invention. The power adapter includes a housing 10, a power input portion, a connecting wire 30 and an electrical connector 40.

The housing 10 is generally shaped like a rectangle. The housing 10 has a wire outlet 11 (as shown in FIG. 2) in one side wall and an output portion 12 in another side wall, which is a USB port in the embodiment. An open retaining groove 14 is formed in a bottom surface 13 of the housing 10. A reel device 15 is mounted in a proper position inside the housing 10 for automatically retracting the connecting wire 30. In this embodiment, the reel device 15 is a reel. The connecting wire 30 may be retracted in the housing 10 via the reel device 15 when in an unused state. The reel device 15 described above may be readily achieved by those skilled in the art and won't be limited by the present invention, so detailed descriptions of the reel device are omitted inhere.

The power input portion in this embodiment is a power plug 20 with two blades 21, which is pivotally mounted on the housing 10. The power plug 20 may engage with a mains supply socket via the two blades 21, so that energy from the mains supply may be transmitted to an electronic device needed to be charged through the connecting wire 30. When in an unused state, the power plug 20 may be turned and received in the retained groove 14.

The connecting wire 30 may be configured to have a conductor (not shown) and an insulating layer (not shown) surrounding the conductor, but not limited in this structure. The connecting wire 30 may be a cable, an arranging wire and so on. In the embodiment, the connecting wire 30 is a flat ribbon cable.

A first end of the connecting wire 30 is extended into the housing 10 through the wire outlet 11 and connected with the reel device 15. Further, the connecting wire 30 may be retracted via the reel device 15. The reel device 15 is electrically connected with some components inside the housing 10, such as a circuit board (not shown), so that the connecting wire 30 may be electrically connected with the housing 10. Besides, the connecting wire 30 is movably extended through the wire outlet 11, so the connecting wire 30 may be pulled out of the housing 10 or received in the housing 10.

In the embodiment, the electrical connector 40 is a Mini-USB connector, but not limited in this, the electrical connector 40 also may be a USB connector, a power connector, a FireWire connector and so on, and may be a male connector or a female connector. The electrical connector 40 is connected with a second end of the connecting wire 30 and extended out of the wire outlet 11. A plurality of terminals (not shown), which are made of conductive material, are disposed in the electrical connector 40 and electrically connected with the conductor (not shown) in the connecting wire 30, so that the electrical connector may be electrically connected with the connecting wire 30.

Figure 3:
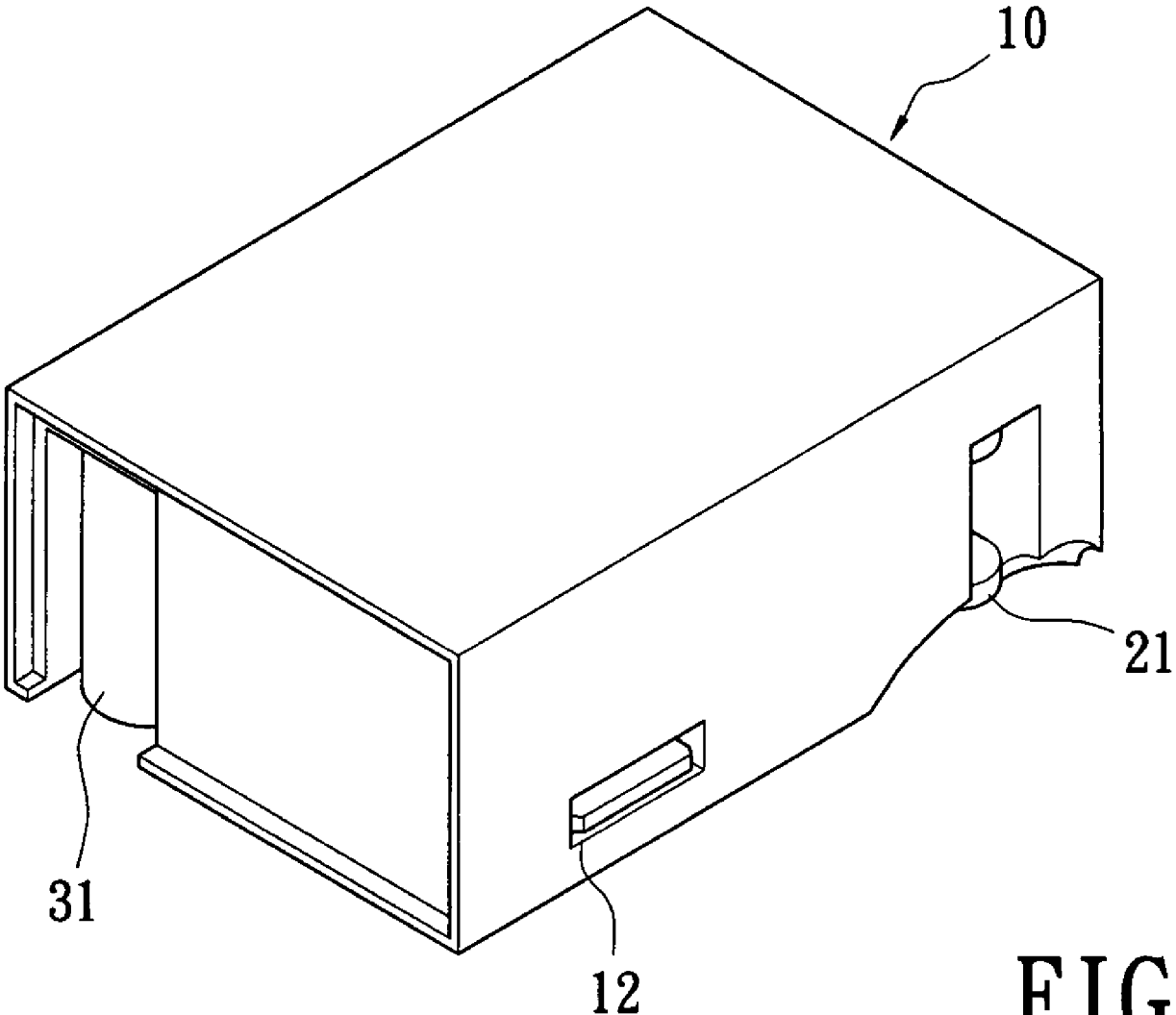
FIG. 3 is a perspective view of a second embodiment of the present invention.
Figure 4:
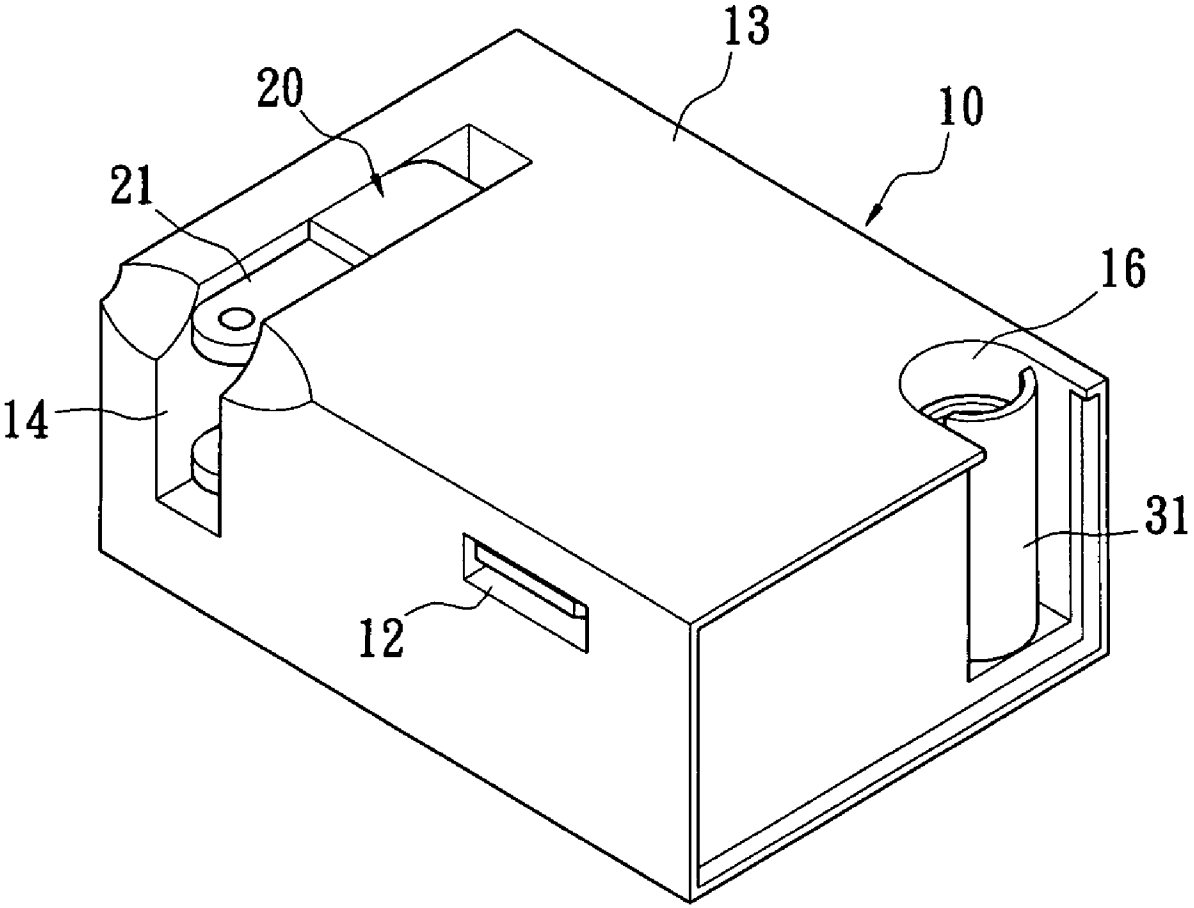
FIG. 4 is a perspective view of the second embodiment of the present invention, from another angle.
Figure 5:
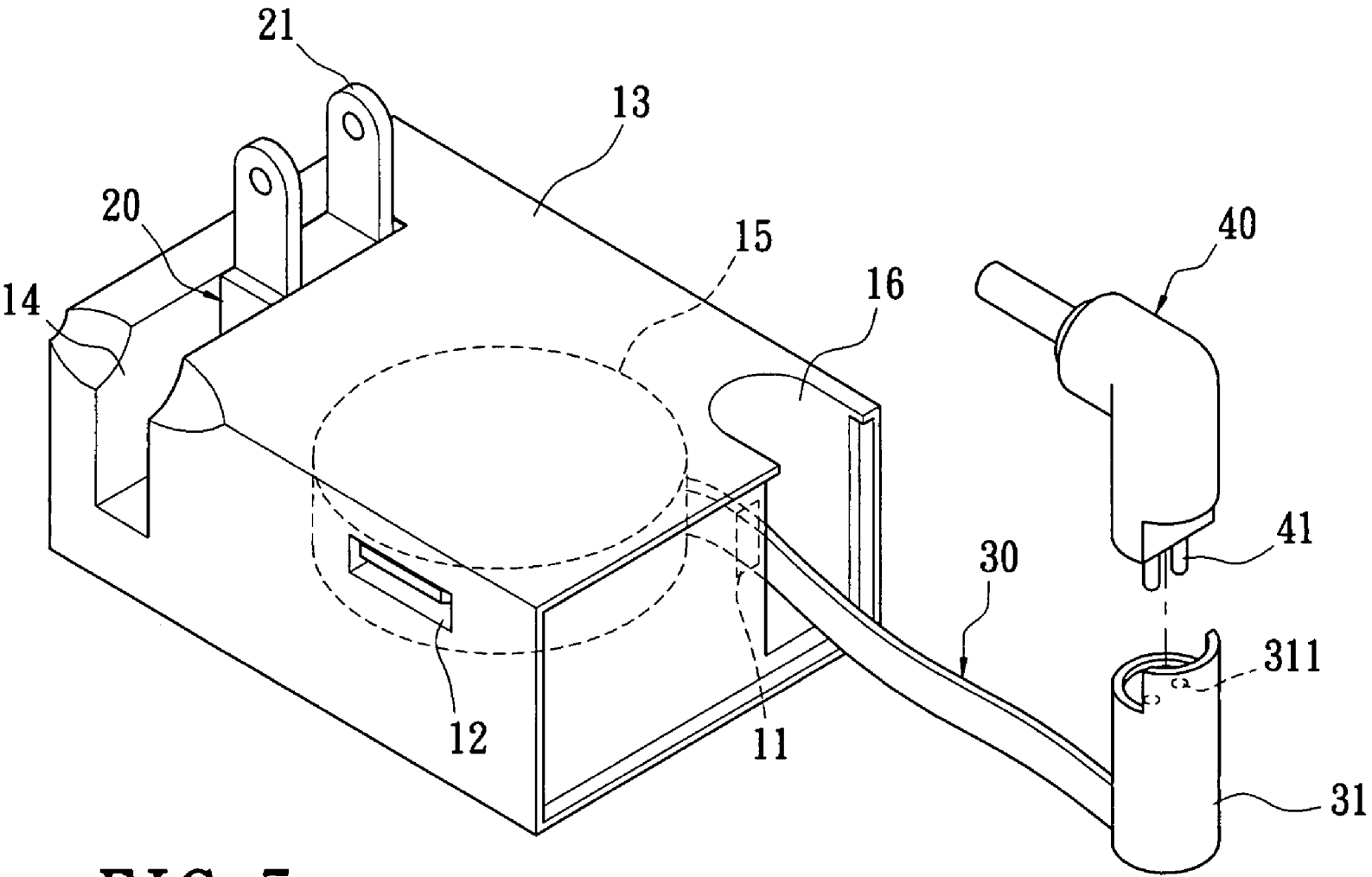
FIG. 5 is a perspective schematic view of the second embodiment of the present invention connected with an electrical connector.

Please refer to FIGS. 3-5, a second embodiment of the present invention is shown. The difference between the second embodiment and the first embodiment is as follows:

The connecting wire 30 has an exchangeable connector 31 mounted on the second end thereof, which has a first connecting portion (in this embodiment, the first connecting portion is insertion holes 311). The connecting wire 30 may be connected with a different electrical connector 40 via the exchangeable connector 31.

In the embodiment, the electrical connector 40 is a power connector, but not limited in this, the electrical connector 40 also may be a Mini-USB connector, a USB connector, a FireWire connector and so on. A second connecting portion (in this embodiment, the second connecting portion is terminals 41) is mounted on one end of the electrical connector 40, corresponding to the first connecting portion. The first connecting portion (that is, the insertion holes 311) and the second connecting portion (that is, the terminals 41) may engage with each other so that the exchangeable connector 31 and the electrical connector 40 are electrically connected.

The housing 10 has a receiving groove 16 extending through one side wall thereof, corresponding to the exchangeable connector 31. The wire outlet 11 is located in the receiving groove 16 (as shown in FIG. 5). When the connecting wire 30 is retracted in the housing 10, the exchangeable connector 31 may be received in the receiving groove 16 and won't protrude out of the housing, thereby users may easily carry and collect the power adapter.

Figure 6:
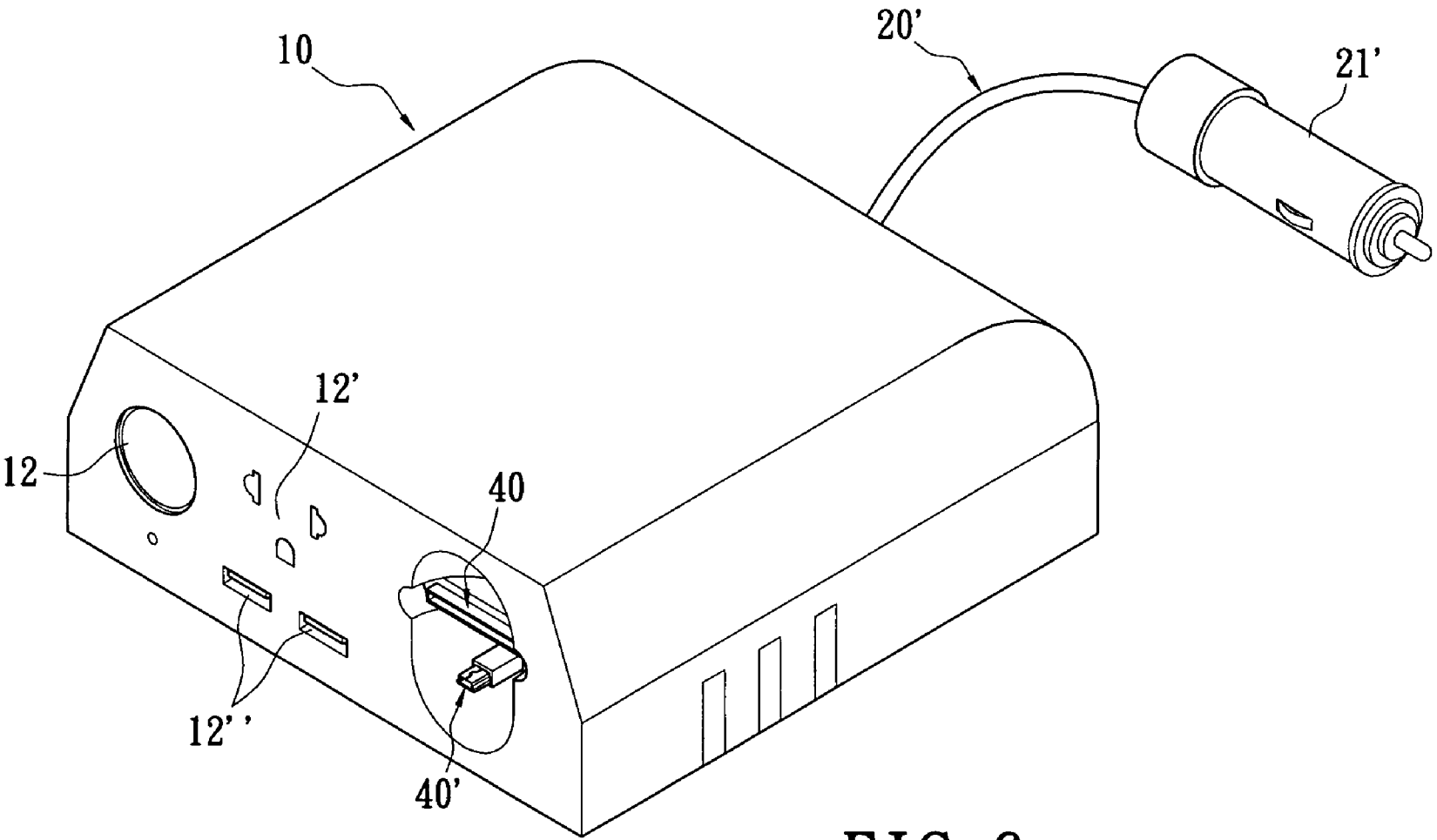
FIG. 6 is a perspective view of a third embodiment of the present invention.
Figure 7:
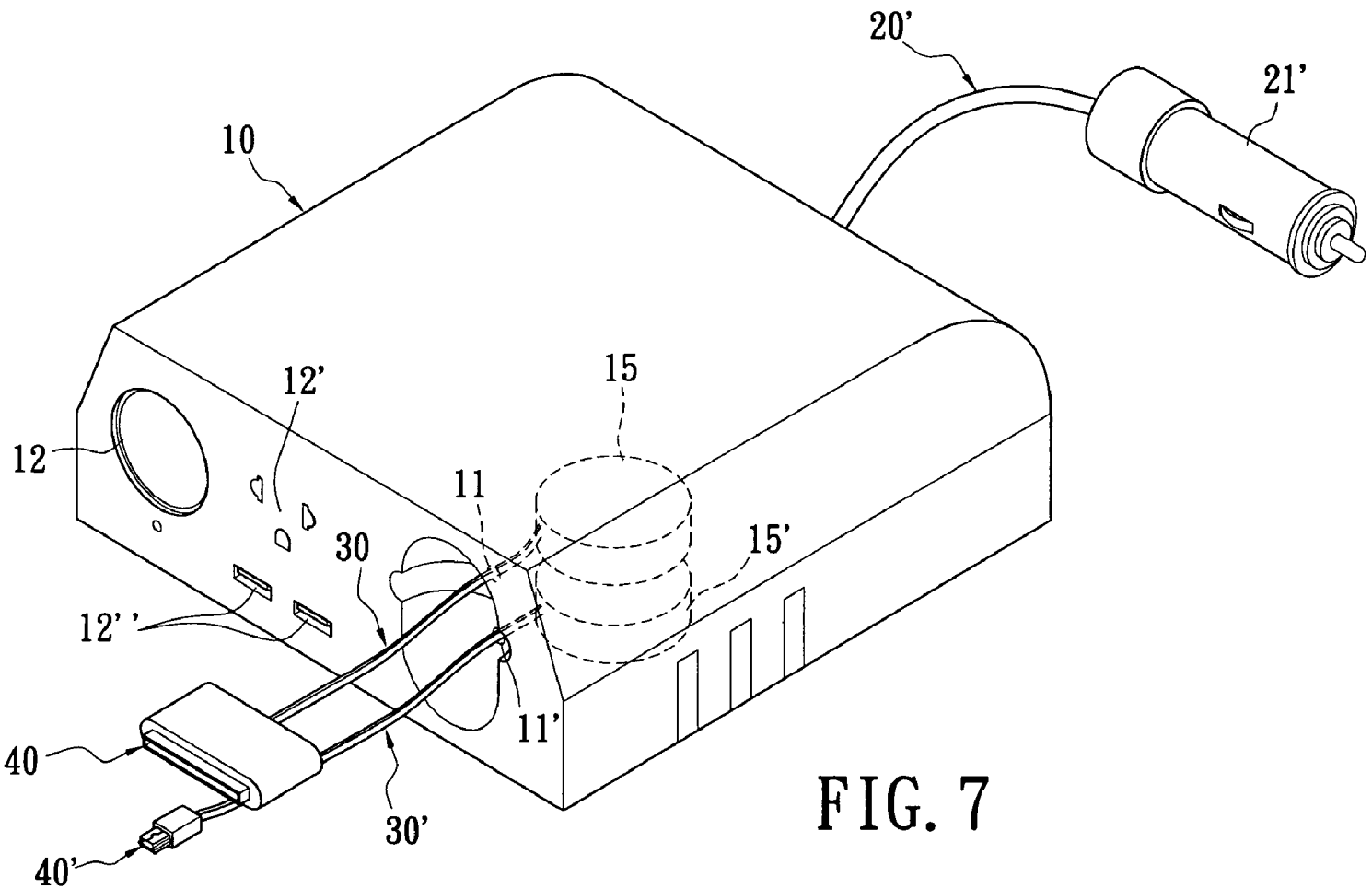
FIG. 7 is a perspective schematic view of the third embodiment of the present invention, when a connecting wire is pulled out.

Please refer to FIG. 6 and FIG. 7, a third embodiment of the present invention is shown. The difference between the third embodiment and the first embodiment is as follows:

The power adapter of the third embodiment includes a housing 10, a power input portion, two connecting wires 30, 30' and two electrical connector 40, 40'.

The housing 10 has two wire outlets 11, 11' (as shown in FIG. 7) and three output portions 12, 12', 12" in one side wall, wherein the two wire outlets 11, 11' are aligned in a vertical direction. In the third embodiment, the output portion 12 is a cigarette lighter plug, the output portion 12' is an AC output socket and the output portion 12" is a USB port. The output portions 12, 12', 12" are respectively connected with proper electronic devices to provide required power.

Two reel devices 15, 15' are mounted in proper positions inside the housing 10 for automatically retracting the two connecting wires 30, 30'. In the third embodiment, both of the two reel devices 15, 15' are reels. The two connecting wires 30, 30' may be retracted in the housing 10 via the two reel devices 15, 15' when in an unused state. The two reel devices 15, 15' described above may be readily achieved by those skilled in the art and won't be limited by the present invention, so detailed descriptions of the two reel devices are omitted inhere.

The power input portion in the third embodiment is a power cord 20' with a joint on a first end. In the embodiment, the joint is a cigarette lighter plug 21' for engaging with a preset cigarette lighter socket in a vehicle, so that the power adapter may be connected to a vehicle power supply.

Figure 8:
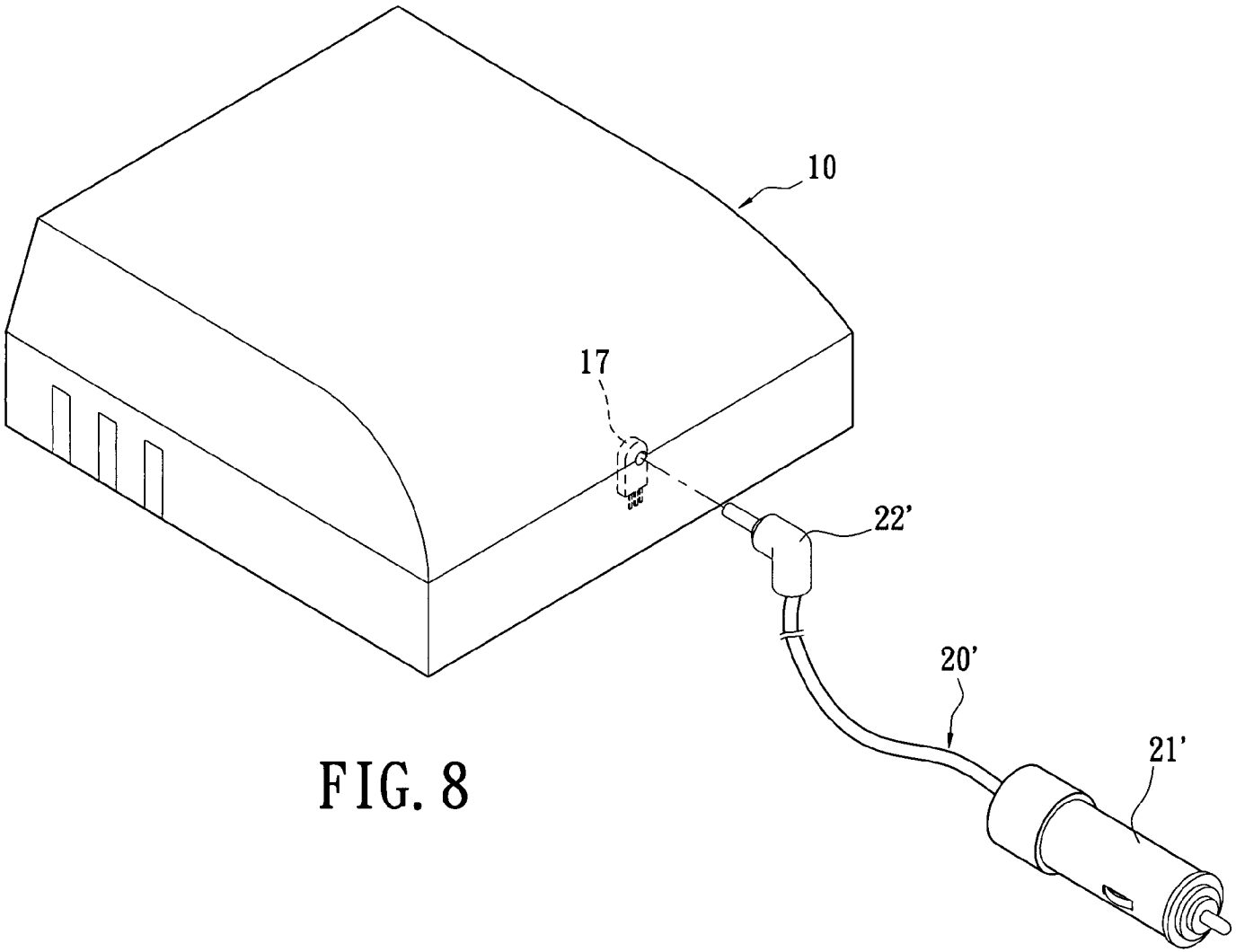
FIG. 8 is a perspective view of the third embodiment of the present invention, from another angle.

A second end of the power cord 20' may be fixed on one side wall of the housing 10 and electrically connected with the housing 10. Alternatively, as shown in FIG. 8, the housing 10 has a first power connector 17 mounted on one side wall thereof and the power cord 20' has a second power connector 22' mounted on the second end thereof, which may engage with the first power connector 17 so that the power cord 20' may be separated from housing 10 and placed independently.

Each of the two connecting wires 30, 30' may be configured to have a conductor (not shown) and an insulating layer (not shown) surrounding the conductor, but not limited in this structure. The connecting wires 30, 30' may be cables, arranging wires and so on. In the embodiment, the connecting wires 30, 30' are flat ribbon cables.

First ends of the two connecting wires 30, 30' are respectively extended into the housing 10 through the two wire outlets 11, 11' and connected with the two reel devices 15, 15'. The two connecting wires 30, 30' may be retracted in the two reel devices 15, 15'. The two reel devices 15, 15' are electrically connected with some components inside the housing 10, such as a circuit board (not shown), so that the two connecting wires 30, 30' may be electrically connected with the housing 10. Further, the two connecting wires 30, 30' are movably extended through the two wire outlets 11, 11', respectively, so the two connecting wires 30, 30' may be pulled out of the housing 10 or received in the housing 10.

The electrical connectors 40, 40' are respectively connected with second ends of the connecting wires 30, 30'. In the embodiment, the electrical connector 40 is a FireWire connector which may be connected to an electronic device such as an iPod and so on for power transmission. The electrical connector 40' is a Mini-USB connector. The two electrical connectors 40, 40' also may be USB connectors or other connectors which aren't limited in male connectors or female connectors.

The two electrical connectors 40, 40' are extended out of the two wire outlets 11, 11'. The two electrical connectors 40, 40' have a plurality of terminals (not shown) disposed therein, which are made of conductive material. The terminals are respectively electrically connected with the conductors (not shown) in the two connecting wires 30, 30', so that the two electrical connectors 40, 40' may be electrically connected with the two connecting wires 30, 30'.

Figure 9:
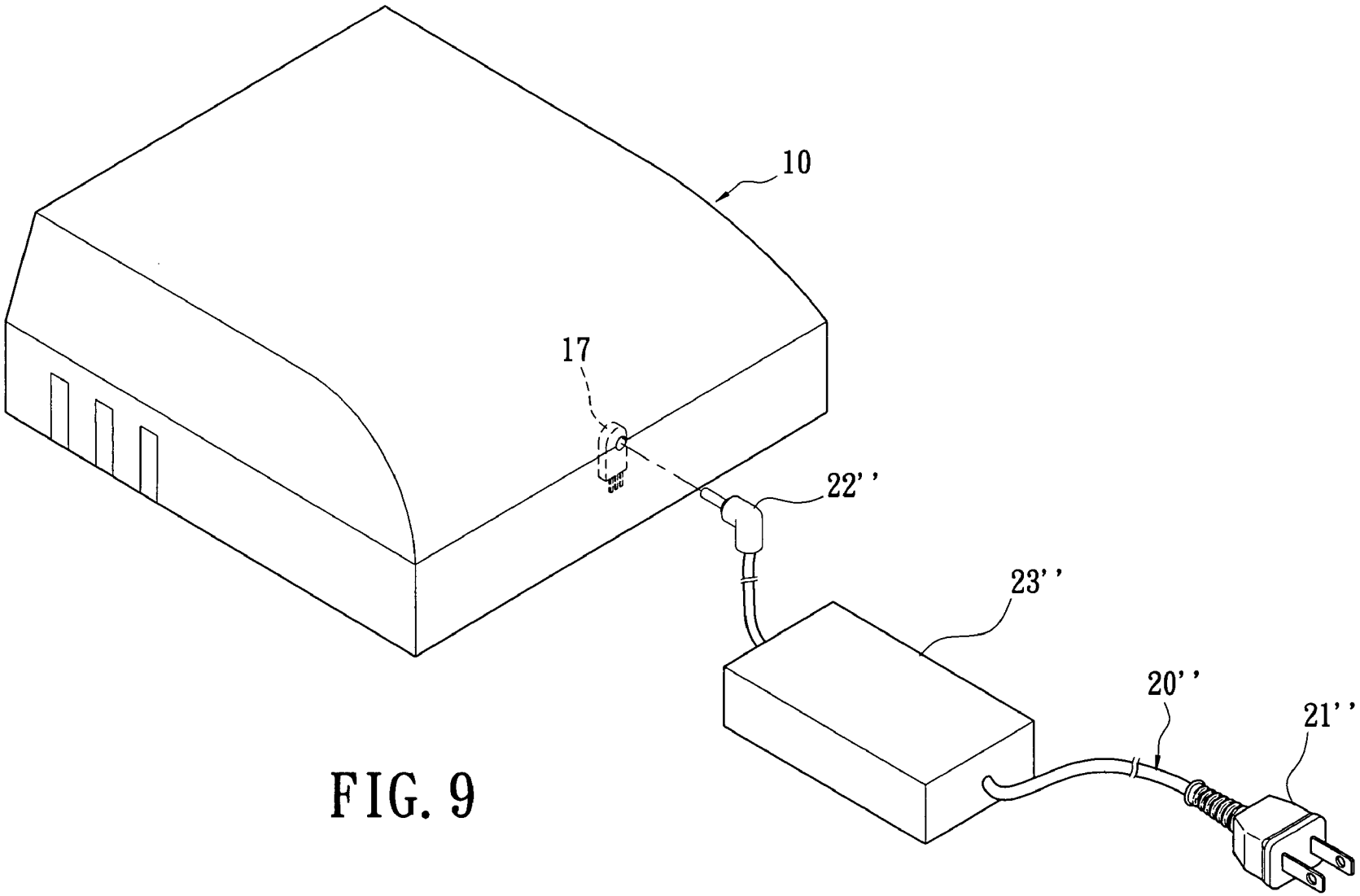
FIG. 9 is a perspective view of a fourth embodiment of the present invention.

Please refer to FIG. 9, a fourth embodiment of the present invention is shown. The difference between the fourth embodiment and the third embodiment is as follows:

The power input portion of the fourth embodiment is another kind of power cord 20". A joint on one end of the power cord 20" is a power plug 21" for engaging with a mains supply socket, thereby the power adapter may be connected to an AC power supply. A second power connector 22" is mounted on the other end of the power cord 22" to engage with the first power connector 17. Furthermore, a transformer 23" is disposed on a middle portion of the power cord 20" to convert alternating current into direct current. Accordingly, the housing 10 may engage with the power cord 20" to form an indoor power adapter.

Consequently, the power adapter according to the present invention is advantageous that:

1. The power adapter of the present invention has the reel device mounted in the housing so that the connecting wire can be retracted via the reel device. As long as users pull the connecting wire out of the power adapter to connect it with an electronic device, the power adapter can transmit energy to the electronic device. So the present invention can transmit energy from a power supply without a transmission line for the electronic device, thereby users needn't carry the transmission line in addition, which lightens users' burden and avoids the problems caused by carrying and collecting the transmission lines.

2. When the power adapter of the present invention is in an unused state, the connecting wire can be automatically retracted in the housing for convenient operation.

3. Since users needn't carry the transmission line for the electronic device, users' burden can be lightened and the problems caused by carrying and collecting the transmission lines can be avoided.

4. The power adapter of the present invention can be connected to more than one electronic devices via the connecting wire and the output portions for supplying power for the electronic devices simultaneously, so the power adapter has preferable applicability.

5. The power adapter of the present invention can be connected to a vehicle power supply or an indoor power supply by replacing different power cords for supplying power for electronic devices, so the power adapter has preferable applicability.

What are disclosed above are only the specification and the drawings of the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. A power adapter, comprising:

a housing, having a reel device mounted therein, a wire outlet formed within a receiving groove formed in an opening in the housing, and a plurality of output portions formed in one side wall thereof, wherein at least one of the plurality of output portions is a cigarette lighter socket;

a power input portion mounted on the housing, wherein the power input portion is an independently detachable power cord, a first end of the power cord having a joint mounted thereon and a second end thereof connectable to one side wall of the housing; wherein the housing has a stationary first power connector, distinct from, and mounted on one side wall thereof and the power cord has a second power connector mounted on the second end thereof, the second power connector removably engaging with the first power connector; and a connecting wire, a first end of the connecting wire extended into the housing through the wire outlet and connected with the reel device, wherein the connecting wire is retractably engaged with the reel device, and a second end thereof connected with an exchangeable connector for connection with an electrical connector, the exchangeable connector being received within the receiving groove and being extendable from within the housing.

2. The power adapter as claimed in claim 1, wherein the reel device is a reel.

3. The power adapter as claimed in claim 1, wherein the output portions are USB ports.

4. The power adapter as claimed in claim 1, wherein the output portions are AC output sockets.

5. The power adapter as claimed in claim 1, wherein the joint is a cigarette lighter plug.

6. The power adapter as claimed in claim 1, wherein the joint is a power plug and a transformer is disposed on a middle portion of the power cord.

7. The power adapter as claimed in claim 1, wherein the connecting wire is a flat ribbon cable.

8. The power adapter as claimed in claim 1, wherein the exchangeable connector has a first connecting portion and the electrical connector has a second connecting portion engaging with the first connecting portion.

9. The power adapter as claimed in claim 1, wherein the electrical connector is a Mini-USB connector.

10. The power adapter as claimed in claim 1, wherein the electrical connector is a USB connector.

11. The power adapter as claimed in claim 1, wherein the electrical connector is a power connector.

12. The power adapter as claimed in claim 1, wherein the electrical connector is a FireWire connector.

* * * * *